US006725632B2

(12) United States Patent
Glucksman et al.

(10) Patent No.: US 6,725,632 B2
(45) Date of Patent: Apr. 27, 2004

(54) APPLIANCE FOR STORING ARTICLES IN AN EVACUATED CONTAINER

(75) Inventors: Dov Z. Glucksman, Wenham, MA (US); Gary P. McGonagle, Lynn, MA (US); Laura J. Nickerson, Andover, MA (US)

(73) Assignee: Appliance Development Corporation, Danvers, MA (US)

( * ) Notice: Subject to any disclaimer, the term of this patent is extended or adjusted under 35 U.S.C. 154(b) by 0 days.

(21) Appl. No.: 10/044,837

(22) Filed: Jan. 11, 2002

(65) Prior Publication Data

US 2003/0131566 A1 Jul. 17, 2003

(51) Int. Cl.[7] ..... B65B 31/00
(52) U.S. Cl. ..... 53/510; 53/432; 251/251
(58) Field of Search ..... 53/510, 432; 251/251, 251/259

(56) References Cited

U.S. PATENT DOCUMENTS

| | | | | |
|---|---|---|---|---|
| 1,594,512 A | | 8/1926 | Von Der Lippe-Lipski | |
| 1,598,089 A | | 8/1926 | Langkoff | |
| 1,967,346 A | | 7/1934 | Barnby | |
| 4,154,044 A | | 5/1979 | Lang | 53/97 |
| 4,372,096 A | | 2/1983 | Baum | 53/88 |
| 4,478,025 A | | 10/1984 | Scanlan | 53/512 |
| 4,744,199 A | | 5/1988 | Gannon | 53/434 |
| 4,909,014 A | | 3/1990 | Kobayashi et al. | 53/510 |
| 4,974,393 A | * | 12/1990 | Rich et al. | 53/433 |
| 5,001,878 A | * | 3/1991 | Sanfilippo et al. | 53/510 |
| 5,035,104 A | * | 7/1991 | Helling et al. | 53/441 |
| 5,056,292 A | * | 10/1991 | Natterer | 53/86 |
| 5,121,590 A | * | 6/1992 | Scanlan | 141/65 |
| 5,239,808 A | | 8/1993 | Wells et al. | 53/512 |
| 5,528,880 A | | 6/1996 | Landolt | 53/432 |
| 5,628,404 A | | 5/1997 | Hendrix | 206/524.8 |
| 5,732,535 A | | 3/1998 | Mitsuta | 53/512 |
| 5,964,255 A | * | 10/1999 | Schmidt | 141/65 |
| 6,012,265 A | | 1/2000 | Ady | 53/103 |
| 6,102,062 A | * | 8/2000 | Pearl, II et al. | 137/1 |
| 6,135,721 A | * | 10/2000 | Hasbrouck | 417/120 |
| 6,145,495 A | * | 11/2000 | Whitcome | 123/525 |
| 6,148,875 A | | 11/2000 | Breen | 141/65 |

* cited by examiner

*Primary Examiner*—Rinaldi I Rada
*Assistant Examiner*—Brian D Nash
(74) *Attorney, Agent, or Firm*—George A. Herbster

(57) ABSTRACT

A vacuum sealing appliance for lidded containers. A container is evacuated by placing a conventional container with a lid under a bell cover or by applying a special lid to an open container. An actuator assembly moves a valve to an sealed position and energizes an electrical vacuum pump. A vacuum switch and solenoid simultaneously terminate the operation of the vacuum pump and allow atmospheric pressure to be applied to the lid, thereby to seal the lid against the container.

11 Claims, 13 Drawing Sheets

APPLIANCE FOR STORING ARTICLES IN AN EVACUATED CONTAINER

BACKGROUND OF THE INVENTION

1. Field of the Invention

This invention is directed to apparatus for evacuating containers and more specifically to an appliance that facilitates the storage of foodstuffs or other articles in a sealed, evacuated container.

2. Description of Related Art

Many times there is a need to store articles, particularly perishable foods, for prolonged intervals. Such prolonged storage can be enhanced if the articles are in an environment that will preserve those articles. For example, it is often desirable to store foodstuffs in a sealed, evacuated container to reduce any interaction between the stored foodstuffs and oxygen and humidity thereby to prevent food spoilage. Such evacuated environments can also prevent other materials from deteriorating.

A wide variety of commercial and domestic apparatus for evacuating rigid and flexible containers exists. Commercial apparatus, however, tends to be physically large, complicated to use and expensive and therefore unsuited to home use. For example, U.S. Pat. No. 1,967,346 (1932) to Barnby discloses apparatus for vacuumizing and sealing containers. This patent discloses a chamber for receiving large numbers of containers and various components that are required to implement container sealing in such large chambers.

Similarly, U.S. Pat. No. 4,154,044 (1979) to Lang discloses an apparatus for sealing cans with lids under vacuum. This apparatus uses a lifting device and a vacuum bell. An unsealed container is placed under the vacuum bell. A vacuum is drawn and evacuates the container while the lid is spaced from the container. Once an appropriate vacuum exists, the lifting device raises the container and presses the lid in place. Then the vacuum bell can be brought to atmospheric pressure and the sealed container can be removed.

U.S. Pat. No. 5,056,292 (1991) to Natterer discloses a packaging machine with a vacuum chamber divided into lower and upper chamber parts. The upper chamber part is movable relative to the lower chamber part. In use articles are placed in a bag in the upper chamber part that then is brought into sealing relationship with the lower chamber part. A vacuum pump evacuates the chamber parts. When the vacuum reaches a prescribed level, sealing bars in the upper chamber part seal the bag. Then air under atmospheric pressure enters the chamber.

As previously stated, apparatus such as that described above are too complicated, unwieldy and costly for household use. Consequently a wide variety of processes and appliances for providing evacuated storage have evolved. The most basic process involves placing an open container with its contents in a boiling water to heat the contents and expand the gas in the container. After the appropriate temperature has been reached, a lid seals the container opening and the container is removed. As the container and contents cool and as the container now has a constant gas volume, the gas pressure reduces to provide vacuum sealing.

In accordance with another approach, flexible bags are evacuated to collapse around articles whereby the bag closely conforms to the articles. For example, U.S. Pat. No. 4,478,025 (1984) to Scanlan discloses a packing device for vacuum sealing perishable materials in bags. A loosely positioned clamp means is placed about the open end of the bag that is filled with foodstuffs or the like. The bag and clamp are placed in a vacuum chamber. As a vacuum is drawn, the bag compresses around the articles and the clamp seals the bag.

U.S. Pat. No. 5,239,808 (1993) to Wells et al. discloses a vacuum packaging machine with a chamber and lid movable between an open position exposing the chamber and a closed position sealing the chamber. The chamber contains a seal bar. In use, the bag and its contents are positioned in the chamber and in the seal bar. A vacuum is drawn to evacuate any air from the bag and collapse the bag closely to the contents. Then the sealing bar forms a seal across the container opening.

U.S. Pat. No. 5,528,880 (1996) to Landolt discloses an apparatus for performing a similar operation utilizing a machine with a vacuum chamber and a number of automatically operated valves and a vacuum sensor. An evacuation operation continues until a predetermined vacuum has been drawn within the chamber. Then another valve opens to atmospheric pressure to complete the sealing operation.

U.S. Pat. No. 5,628,404 (1997) to Hendrix discloses a portable self-contained vacuum packing device with an outer flexible container, two one-way valves and an inner flexible container. Squeezing the outer container compresses the air and causes the flexible inner container to conform to the contents. Air escapes through one of the one-way valves that blocks the return of air into the compressed inner container or package.

In a more mechanized approach particularly adapted for rigid containers, vacuum sealing devices include platforms, bell covers or jars for providing evacuation chambers and manual pumps for evacuating containers with lids. For example, U.S. Pat. No. 1,594,512 (1924) to Von der Lippe-Lipski discloses an apparatus for preserving food in which a container with a loose fitting top is placed in an evacuation chamber. The chamber is evacuated with a manual pump thereby reducing the pressure within the container as air passes from the container past the loose fitting lid. Then atmospheric air is admitted to close the lids on the food jars and hermetically seal the contents.

U.S. Pat. No. 4,372,096 (1983) to Baum discloses a vacuum sealing device that generates a vacuum in the head space of a jar by means of a hood connected to an external vacuum pump. A valve assures that air under atmospheric pressure can not enter the hood until the lid has been pressed against the top edge of the jar's mouth.

U.S. Pat. No. 4,909,014 (1990) to Kobayshi et al. discloses a vacuum storage device with a base member, a housing sealingly and removably mounted on the base member to form a storage chamber, a pressure reducing device mounted on either of the base member and housing member and a means for introducing air into the storage chamber. In this disclosure a bell and bellows pump with a valve provides a method of reducing the air pressure within the storage chamber. After predetermined pressure reduction has been achieved, another valve admits air at atmospheric pressure into the storage chamber thereby to seal a lid to a container.

Each of these devices provide evacuated containers utilizing a fully manual operation. Moreover the apparatus tends to be overly complicated and involves entirely manual control. More recently, however, a vacuum sealing appliance for home use has been presented that utilizes an electric vacuum pump, a valve and control system that simplifies the sealing of a lidded container. More specifically, U.S. Pat. No.

6,012,265 (2000) to Ady discloses a portable vacuum apparatus with a vacuum chamber for lidded jars and the like. The vacuum chamber comprises a platform covered by a layer of resilient materials serving as a seal and a removable cover seated on the platform. Piping connects the vacuum chamber to an electrically operated vacuum pump and to an automatic valve that can connect the chamber with the atmosphere. To evacuate a jar or container in the chamber, the valve is manually closed to start pumping thereby exhausting air from the chamber and the jars. When the required vacuum has been reached, the valve opens automatically and interrupts the electrical supply to the vacuum pump. The valve also forms a wide passageway to the chamber causing air to rush in and create a shockwave. The lids on the jars and containers are conventional and have gaskets that are slightly lifted off the seats during evacuation. The shockwave firmly presses the lids onto the containers and closes the container under a vacuum condition.

More specifically, as the vacuum increases, a pressure differential exists across a sliding valve member held in position by a restraining mechanism. When the differential pressure across the valve, produced by the reduced pressure and atmospheric pressure on the opposite sides of the valve, becomes sufficiently great, the restraining force provided by the detent is overcome. The valve slides to the open position. In one embodiment the restraining mechanism comprises a mechanical detent; in another, by a permanent magnet. It has been found that this valve can not guarantee a release at a constant vacuum with either a mechanical or magnet restraining mechanism. Both restraining mechanisms are dependent upon environmental effects, machine tolerances, wear and tear and other factors for determining their release points. Consequently the vacuum at which air is admitted can vary from apparatus to apparatus and, within a given apparatus, over time. Moreover, the device shown can be applied only with a bell jar. However, it is often desirable to evacuate containers that are larger than the bell jar. The Ady patent does not disclose any method for evacuating such lidded containers. What is needed is a low-cost reliable vacuum sealing appliance for lidded containers that is easy to use and adapted for home use.

SUMMARY

Therefore it is an object of this invention to provide an improved appliance for evacuating lidded containers.

Another object of this invention is to provide an improved appliance for evacuating lidded containers in a non-commercial or home environment.

Still another object of this invention is to provide an improved appliance for evacuating lidded containers that is simple to operate.

Yet another object of this invention is to provide an improved appliance for evacuating lidded containers that can be manufactured at reasonable costs.

Yet still another object of this invention is to provide an improved appliance for evacuating lidded containers both in a bell jar on the appliance and containers that are remote from the appliance.

In accordance with one objective of this invention, a vacuum sealer for sealing the contents of a lidded container includes a vacuum pump and a vacuum chamber that receives the container with a loosely positioned lid. A controller contains a valve operable between sealed and unsealed positions and a vacuum switch. Operation begins by moving the valve to its sealed position thereby activating the vacuum pump to evacuate air from the container and the vacuum chamber. When the vacuum switch indicates a predetermined vacuum, the valve is permitted to return to its unsealed position allowing air at atmospheric pressure to rush into the vacuum chamber and seal the lid against the container and turning off the vacuum pump.

In accordance with another aspect of this invention, a system for vacuum sealing a container includes a housing with first and second internal cavities separated by a wall. First and second ports extend through the wall. A vacuum pump and control system are located in the first cavity. A vacuum chamber base also attaches to the housing. A first vacuum hose extends between the first port and the vacuum pump and a second vacuum hose extends between the second port and the vacuum chamber base. A third vacuum hose in the second cavity connects to the first port and releasably connects to the second port. The third vacuum hose and second port have complementary fittings to form a releasable interconnection. For remote operations a lid is placed on an open container separated from the vacuum chamber base. The third vacuum hose then attaches to a vacuum fitting corresponding to the second port fitting. Thereafter, energizing the vacuum pump evacuates the container under the lid.

BRIEF DESCRIPTION OF DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
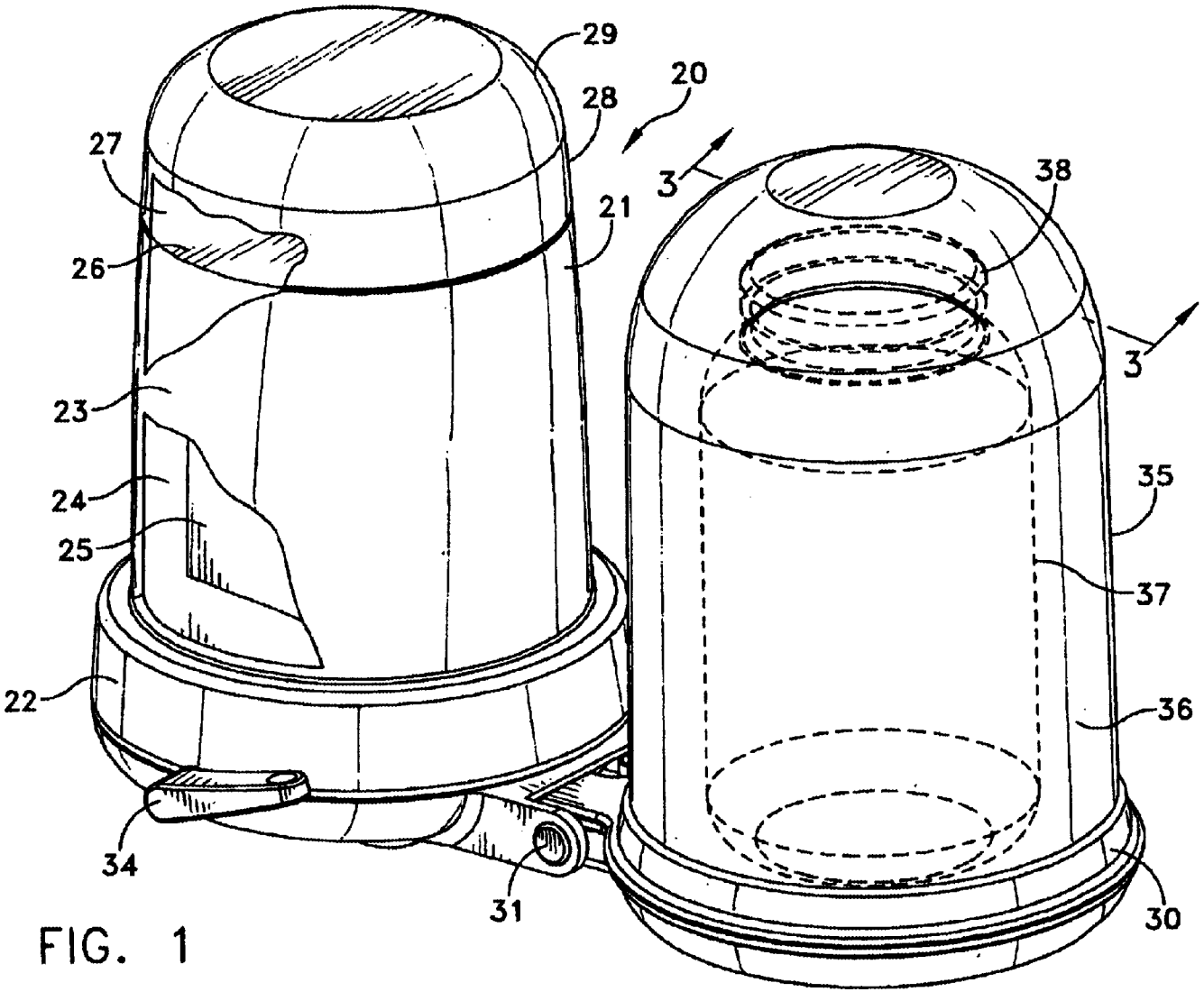
FIG. 1 depicts a vacuum sealing appliance constructed in accordance with this invention.

FIGS. 1 through 4 depict the appearance of one embodiment of a vacuum sealing appliance 20 constructed in accordance with this invention. The appliance 20 includes a housing 21 on a base 22 that serves as a stand for the appliance 20. A middle housing 23 defines a lower cavity 24 for an operating mechanism 25. A barrier or floor 26 divides the interior of the housing 21 to define an upper cavity 27 with a housing wall 28 with a cover 29.

Figure 2:
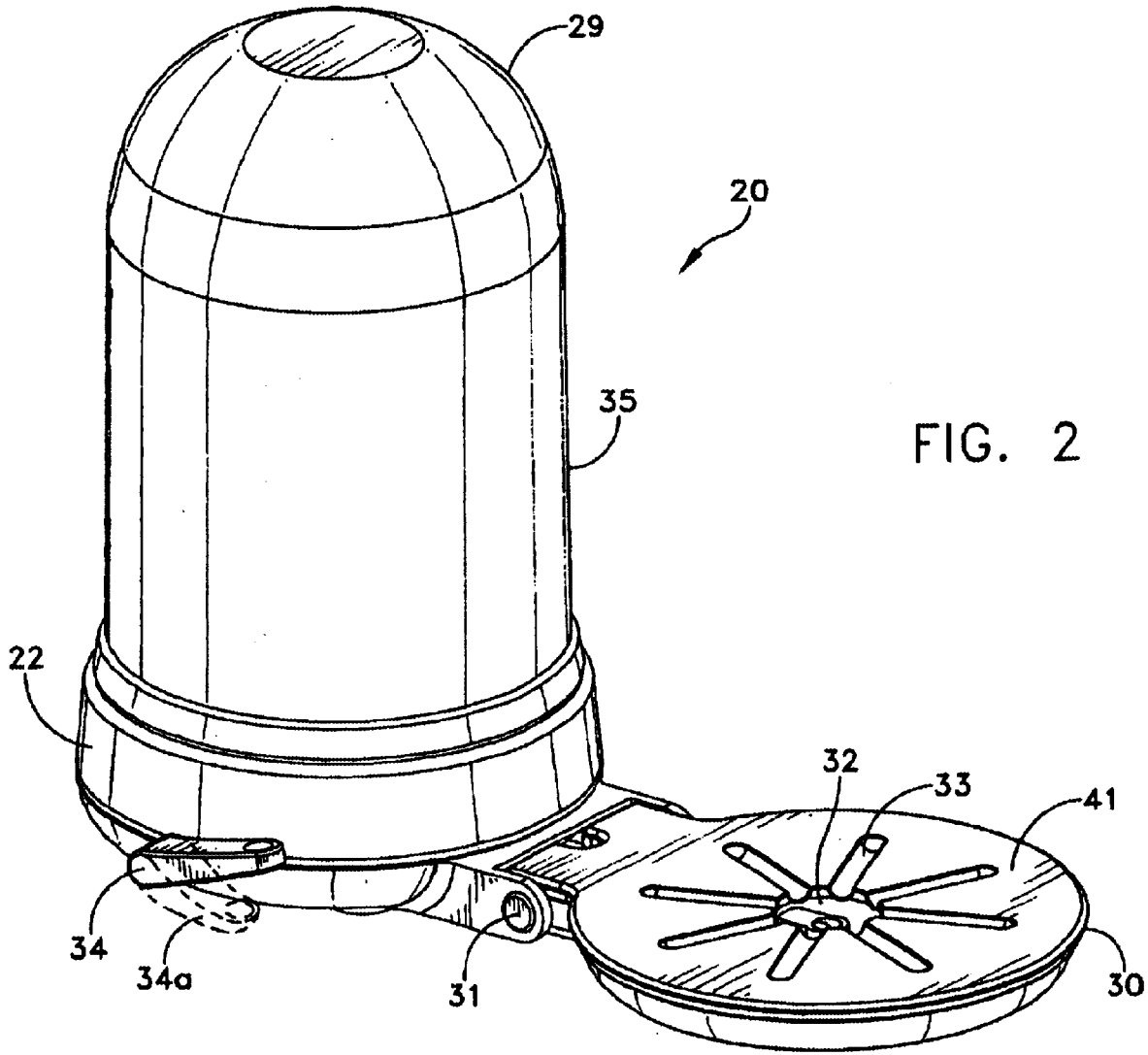
FIG. 2 depicts the vacuum sealing appliance of FIG. 1 in another configuration.
Figure 3:
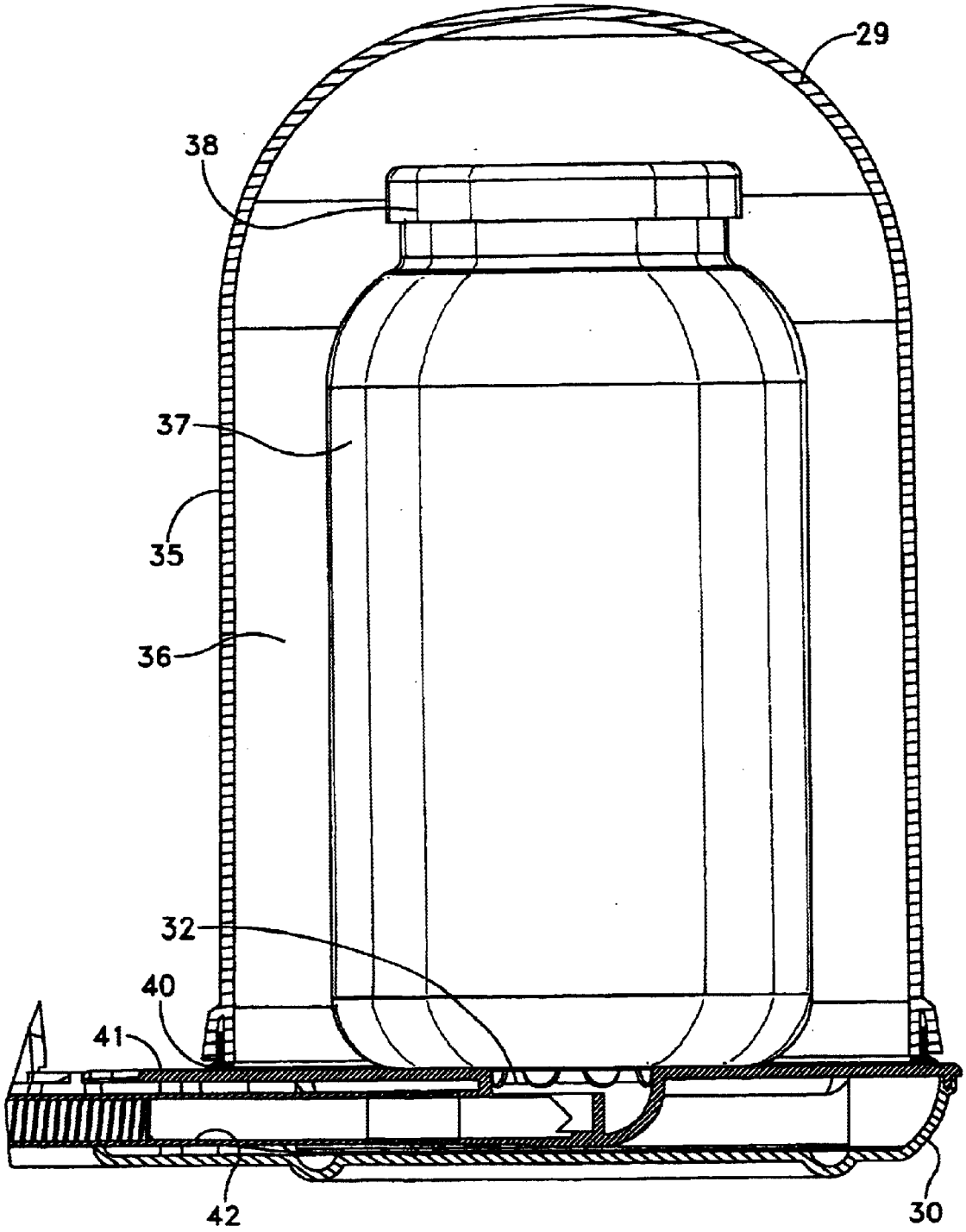
FIG. 3 is a partial cross section of the vacuum appliance taken along lines 3—3 in FIG. 1.
Figure 4:
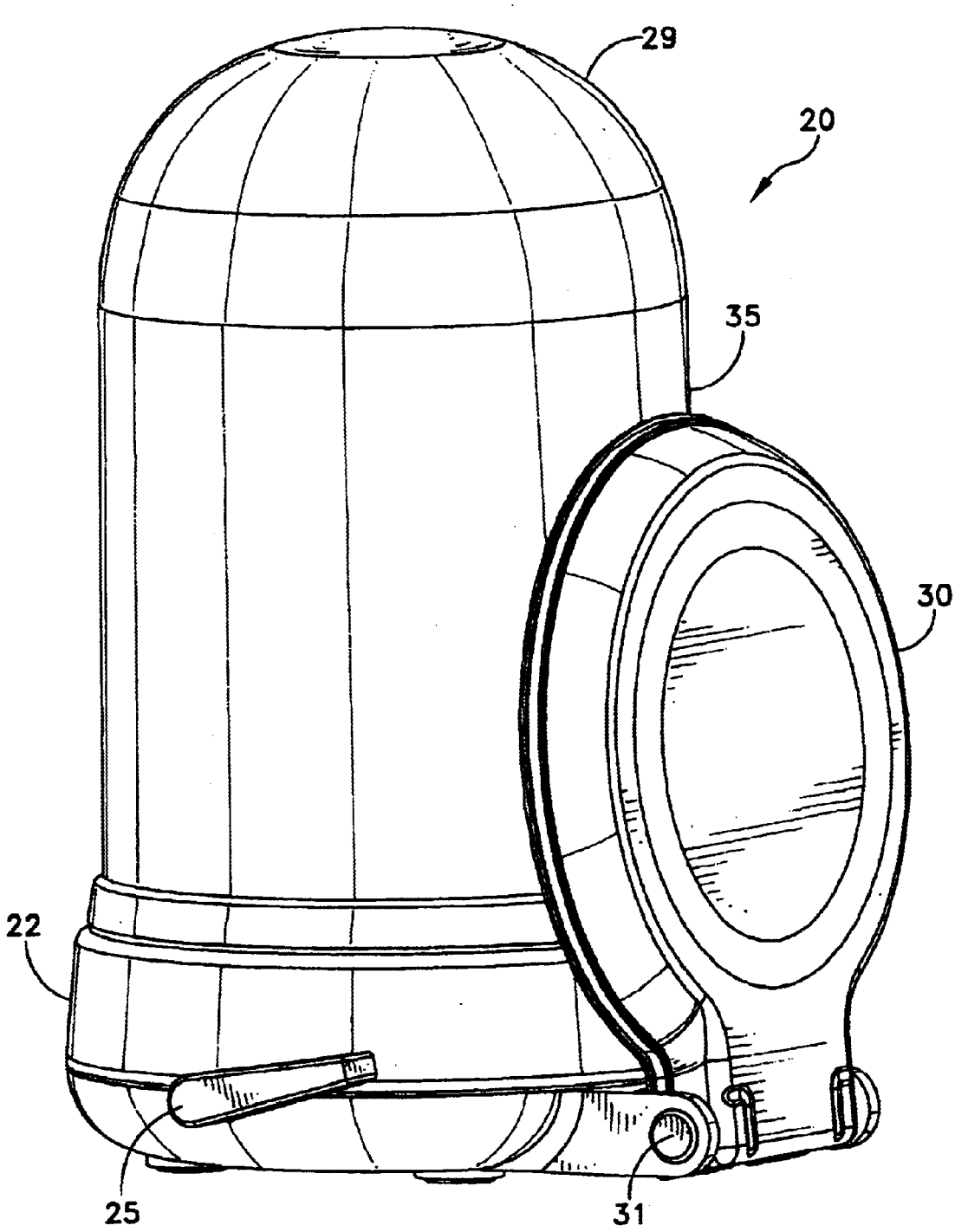
FIG. 4 depicts the vacuum appliance of FIG. 1 in a storage configuration.

The appliance 20 additionally includes a vacuum chamber base 30 that can pivot from a vertical storage position as shown in FIG. 4 to an operating position as shown in FIGS. 1 through 3. The base 30 pivots on hinge pins 31. The hinge pins 31 have a friction fit with the base 30 so the base will remain in any angular orientation relative to the base 22.

As particularly shown in FIG. 2, the vacuum chamber base 30 includes a central opening or port 32 and elongated channels 33 that radiate from the central port 32. As will become clearer later, a vacuum pump in the operating mechanism 25 pulls a vacuum through the central and radial port 32 and channels 33. The channels 33 extend beyond any container placed in the vacuum chamber 36. This assures at least one air passage exists during the evacuation of the vacuum chamber 36.

A first arm in the form of an operating lever 34 at base 22 connects to the operating mechanism 25 and initiates an operation after a bell cover 35 is placed on the base 30 as shown in FIG. 1. This forms a vacuum chamber 36 that is coextensive with the ports 32 and 33. FIGS. 1 and 3 also depict a standard container 37 and lid 38 on the vacuum chamber base 30 beneath the bell cover 35. The housing 21 and bell cover 35 can be sized so that as shown in FIGS. 2 and 4, the housing 21 carries the bell cover 35 for storage. FIG. 4 additionally shows the vacuum chamber base 30 pivoted about the hinge pins 31 to a stable vertical storage position.

During a typical operation, articles, such as food, are placed in the container 37. The container 37 is then positioned on the vacuum chamber base 30 with the orientation shown in FIGS. 1 and 3. The lid 38 loosely fastened on the top of the container 37. The bell cover 35 is then transferred from its storage position in FIG. 2 to the position shown in FIGS. 1 and 3. In this position, a bottom seal 40 carried by the bell cover 35 as shown in FIG. 3 forms a seal against the top surface 41 of the vacuum chamber base 30.

Next the operating lever 34 is rotated to a second position shown in phantom in FIG. 2 and designated by 34A. This rotation initiates the operation of the vacuum sealer 20 by activating a vacuum pump and moving a valve to a sealed position as described later. The vacuum pump exhausts air in the vacuum chamber 36 and the container 37 through the vacuum chamber base 30, particularly the ports 32 and channels 33 and then through a vacuum hose 42 that connects to the valve. When the vacuum reaches an appropriate level, this valve transfers to an unsealed position and allows air at atmospheric pressure to enter the vacuum chamber 36 through the port 32 and channels 33 causing the lid 38 to seat firmly on the container 37. Then the bell cover 35 can be removed and the lid 38 can be firmly tightened for storage.

Figure 5:
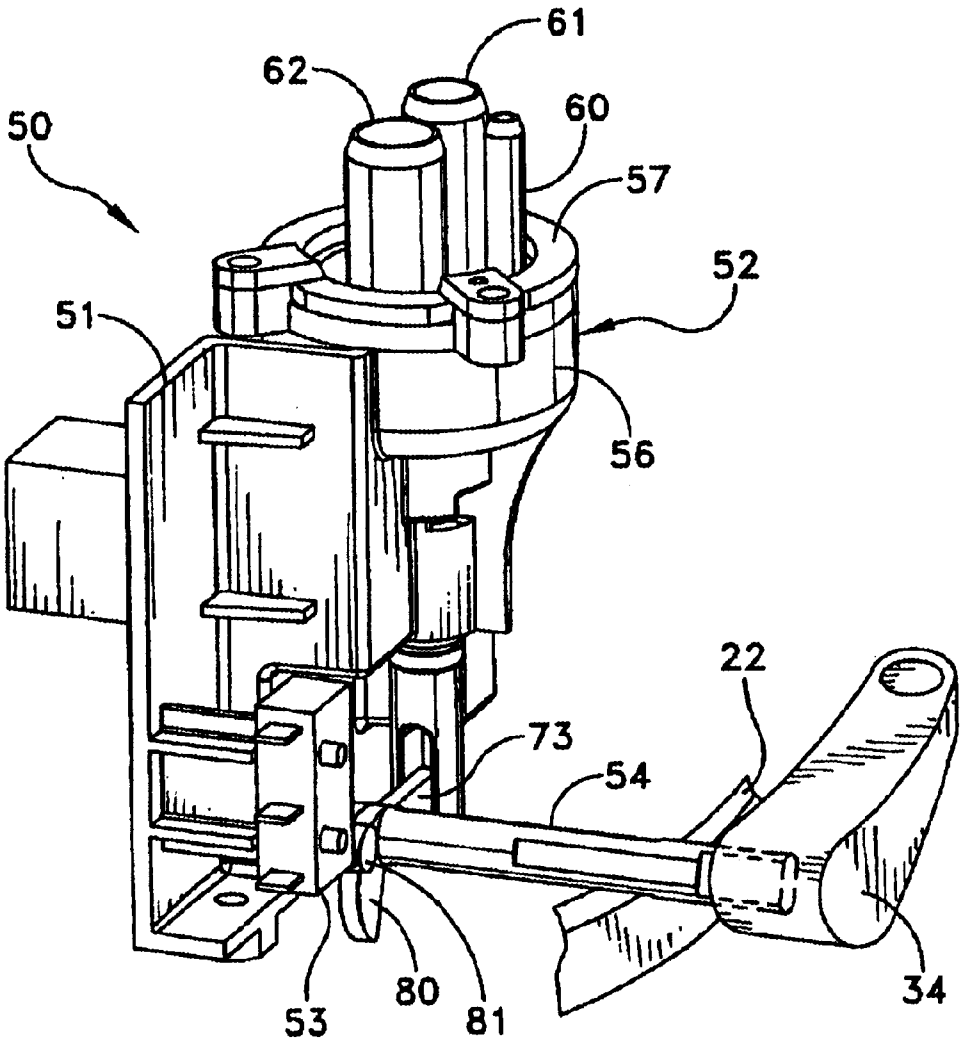
FIG. 5 is a perspective view of the mechanical components of a controller that is useful in a preferred embodiment.
Figure 6:
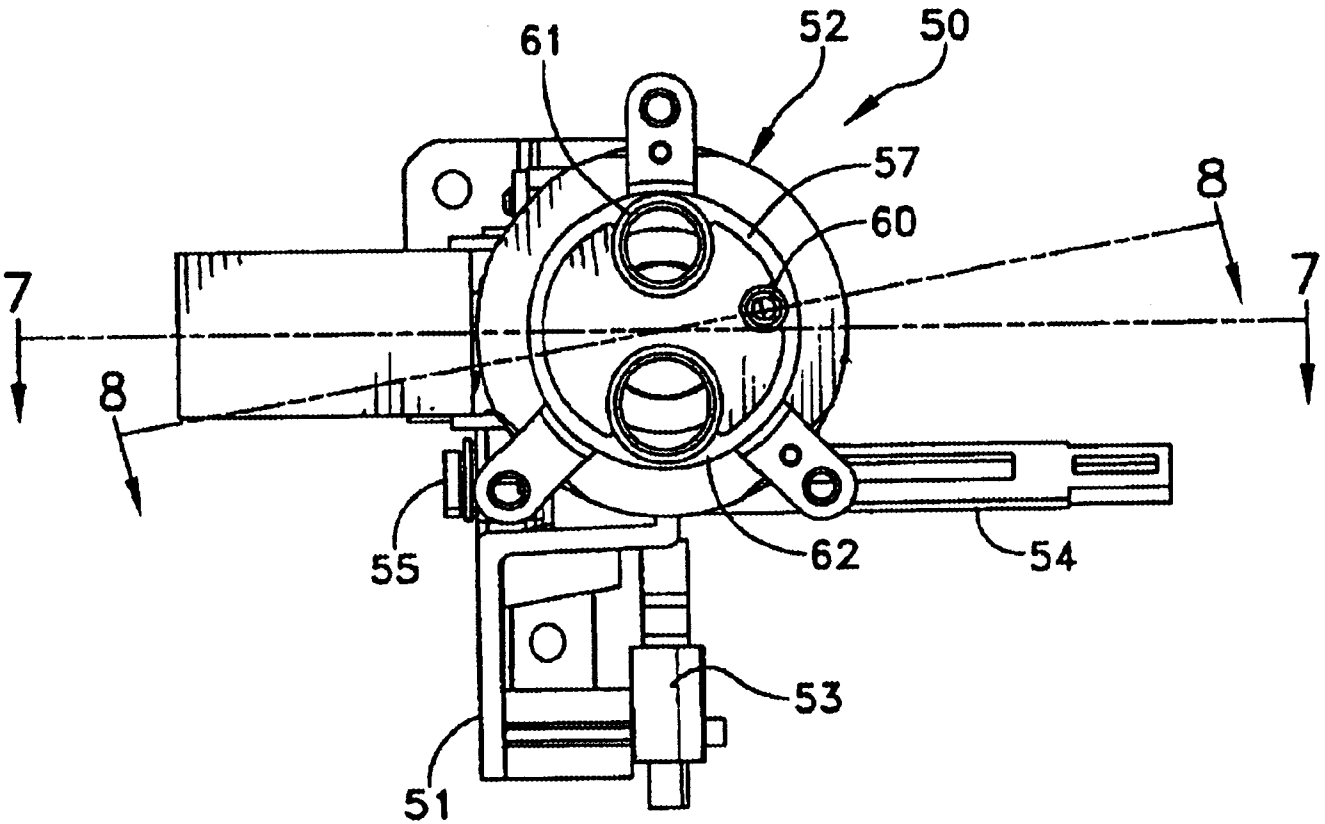
FIG. 6 is a top view of the controller components in FIG. 5.

FIG. 5 is perspective view of one embodiment of a valve assembly 50 contained in the operating mechanism 25 shown in FIG. 1. Still referring to FIG. 5, a support 51 carries a valve 52, an electric switch 53 and a shaft 54 in the lower cavity 24 in FIG. 1. A journal 55, shown in FIGS. 6 through 10, supports one end of the shaft 54 for rotation about a shaft axis. The opposite end of the shaft 54 extends through the base 22 to carry the operating lever 34 as an actuator for initiating the evacuation process.

Still referring to FIG. 5, the valve 52 includes a valve body 56 and a cover 57 that spans an opening of the valve body 56. The cover 57 carries three ports 60, 61 and 62. Referring particularly FIGS. 7 through 10, each port communicates with a first valve chamber 63 defined by a first wall portion 64 adjacent to the cover 57. The wall portion 64 transitions to a reduced cross section wall portion 65 thereby to define a second cavity 66. Thus, the valve body 56 defines the first cavity 63 with a given cross section adjacent the valve cover 57 that is greater than the cross section of the second cavity 66 that in turn is displaced from the first cavity 63. The second cavity 66 additionally includes an atmospheric port 67 that forms a passage to allow air at atmospheric pressure to enter the cavity 66.

Figure 8:
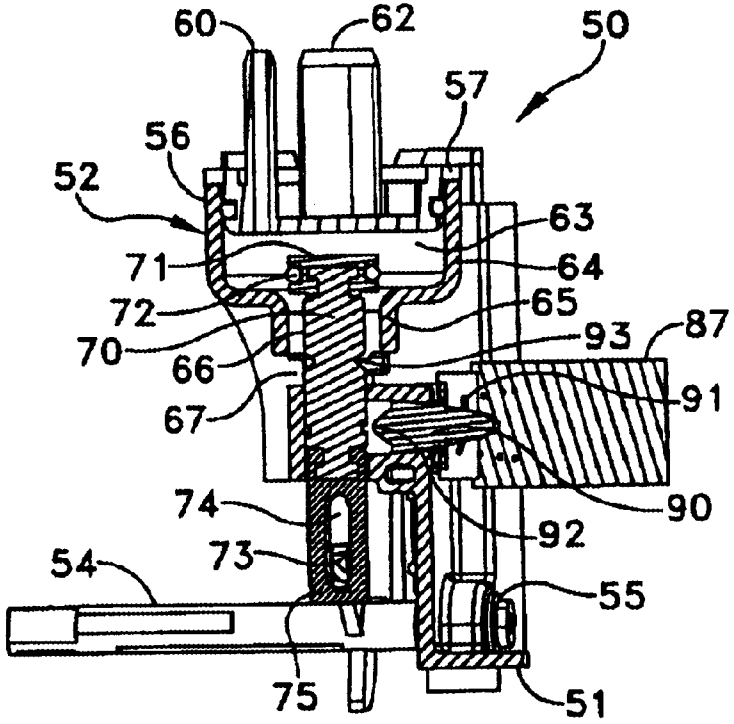
FIGS. 7 and 8 are cross sectional views taken along lines 7—7 and 8—8 of FIG. 6, respectively, showing the controller in an unsealed position.
Figure 7:
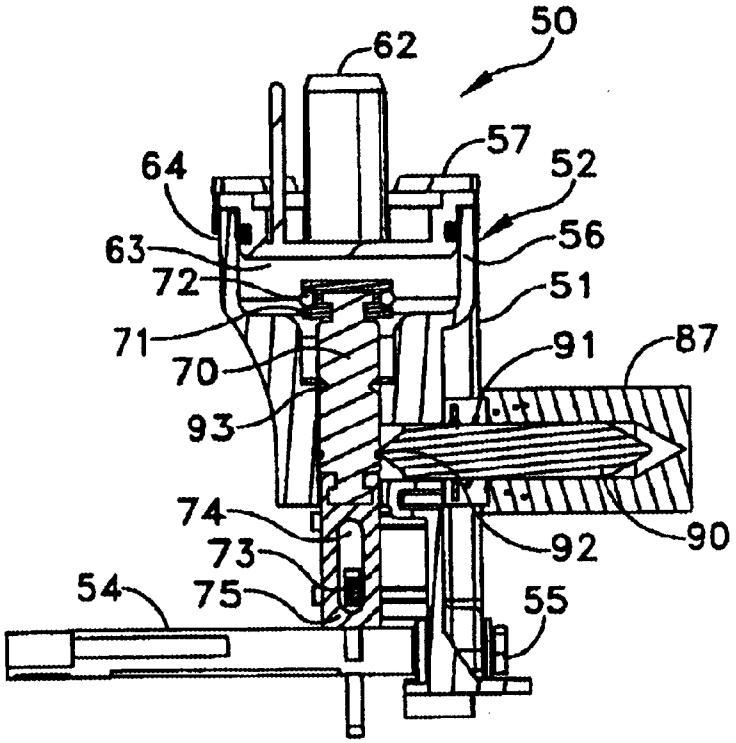

Now referring to FIGS. 7 and 8, the valve assembly 50 includes a valve slider 70 with a sealing element 71 at one end. In the embodiment shown in FIGS. 7 and 8 the sealing element 71 is at the upper end of the slider 70 and carries an O-ring 72. When the operating lever 34 is in the position shown in FIG. 1, an end portion of a second radial arm in the form of a radially extending arm 73 from the shaft 54 lies in an elongated slot 74 in a bottom portion 75 of the slider 70. In this embodiment the bottom portion 75 is shown as a separate element, but the slider 70 could also be formed as a unitary element. In FIGS. 7 and 8 the slider 70 is in a first or upper position whereby air at atmospheric pressure can pass through the atmospheric port 67 and the cavity 66 into the cavity 63. This constitutes an unsealed position for the sealing element 71 and O-ring 72.

Figure 10:
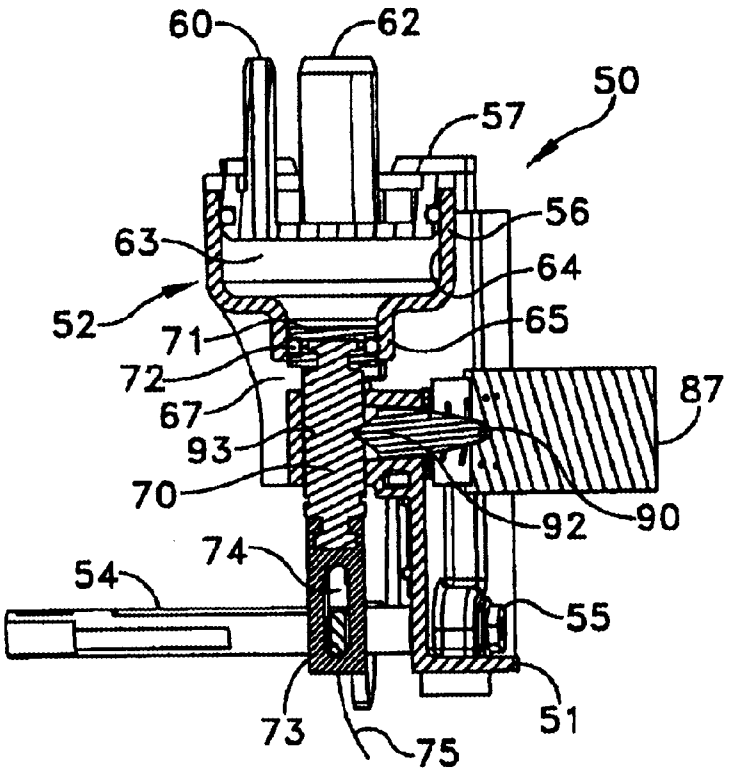
FIGS. 9 and 10 are cross sectional views corresponding to FIGS. 7 and 8, but showing the controller in a sealed position.
Figure 9:
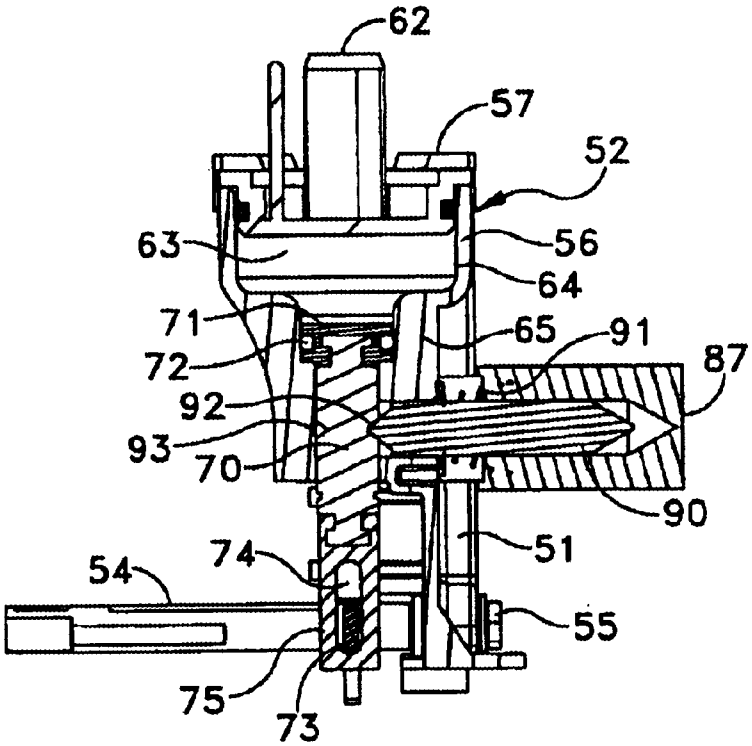

When the operating lever 34 shown in FIG. 5 rotates clockwise to a second position, the arm 73 interacts with the bottom portion 75 of the slider 70 to pull the sealing element 71 with its O-ring 72 down to the position shown in FIGS. 9 and 10. This forms a seal across the cavity 65 and blocks any air at atmospheric pressure from entering the cavity 63 through the atmospheric port 67. This is the sealing position of the sealing element 71 and O-ring 72.

Referring again to FIG. 5, the shaft 54 also carries a cam 80 positioned adjacent a roller 81 on a switch actuator arm attached to the electrical switch 53 that, when closed, energizes the vacuum pump. In the position shown in FIG. 5 with the operating lever 34 in a first position and the sealing element 71 in the unsealed position as shown in FIGS. 7 and 8, the switch 53 is turned off. When the operating lever 34 rotates clockwise to the second position, the cam 80 moves against the roller 81 and the switch 53 closes, turning on the vacuum pump. This occurs as the slider 70 and sealing element 71 move into the sealing position shown in FIGS. 9 and 10. Consequently, when the vacuum pump begins pumping, it immediately begins to evacuate the cavity 63 and the vacuum chamber 36 in FIGS. 1 and 3 without the introduction of air from the surrounding atmosphere past the sealing element 71 and the O-ring 72.

Figure 11:
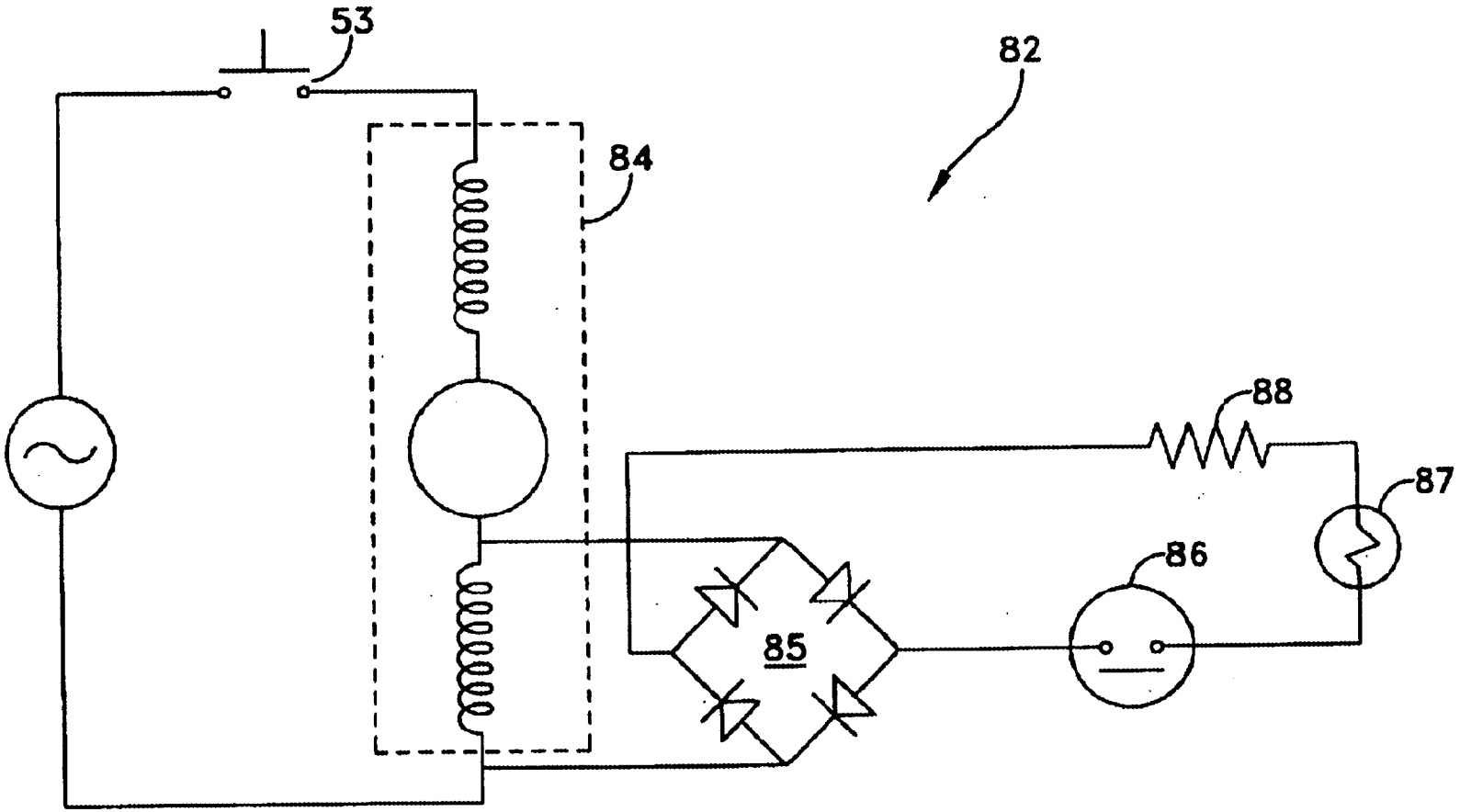
FIG. 11 is a schematic of a control circuit useful with the controller of FIG. 5.

FIG. 11 is a schematic of a control circuit 82 that includes a connection to a power source, such as 120 volt AC line voltage, to an electrically operated vacuum pump represented schematically at 84 and to the normally open contacts of the switch 53. When the switch 53 closes, power energizes the vacuum pump 84. One of the vacuum pump motor field windings connects to a full-wave bridge rectifier circuit 85 that energizes a series circuit comprising a vacuum switch 86, a solenoid 87 and a load-limiting resistor 88. When the switch 53 closes, the vacuum pump 84 turns on and begins to draw a vacuum. When the vacuum reaches a predetermined level established by a first pressure threshold, the normally open contacts of the vacuum switch 86 close and energize the solenoid 87. When the pressure increases to another threshold, the vacuum switch 85 opens.

Referring again to FIGS. 7 through 10, the solenoid 87 includes an armature 90 normally biased by a spring 91 to an extended position as shown in FIGS. 9 and 10. In this position, an end tip 92 of the armature 90 engages a circumferential groove 93 in the slider 70 thereby to produce a detent action that blocks motion of the slider 70. So long as the solenoid 87 is de-energized, the end tip 92 engages the slider in the groove 93 and blocks any motion of the slider 70 produced by a pressure deferential across the sealing element 71. Consequently the solenoid 87 prevents the sealing element 71 and O-ring 72 from moving to an unsealed position.

If it is desired to terminate the operation prematurely, it is merely necessary to move the operating lever 34 toward the position shown in FIG. 1. This motion causes the arm 73 to move the slider 70 so the groove 93 displaces from the armature 90. The slider 70 is then free to move to the unsealed position.

However, when the appropriate vacuum has been realized, the solenoid 87 is energized momentarily until the cam 80 rotates as the slider 70 moves to open the electrical switch 53 and de-energizes the solenoid 87. This momentary energization of the solenoid retracts the armature 90 from the groove 93 momentarily. The sealing element 70 has atmospheric pressure acting from the cavity 66 and the reduced pressure acting from the cavity 63. With the detent released momentarily, the differential pressure drives the sealing element 71 and O-ring 72 from the sealed position shown in FIGS. 9 and 10 to the unsealed position shown in FIGS. 7 and 8. Air at atmospheric pressure is then free to fill the vacuum chamber 36 rapidly. The resulting pressure increase seals the lid 38 onto the container 37. This completes the sealing operation except for moving the bell cover 35 and tightening the lid 38 on the container 37.

Figure 12:
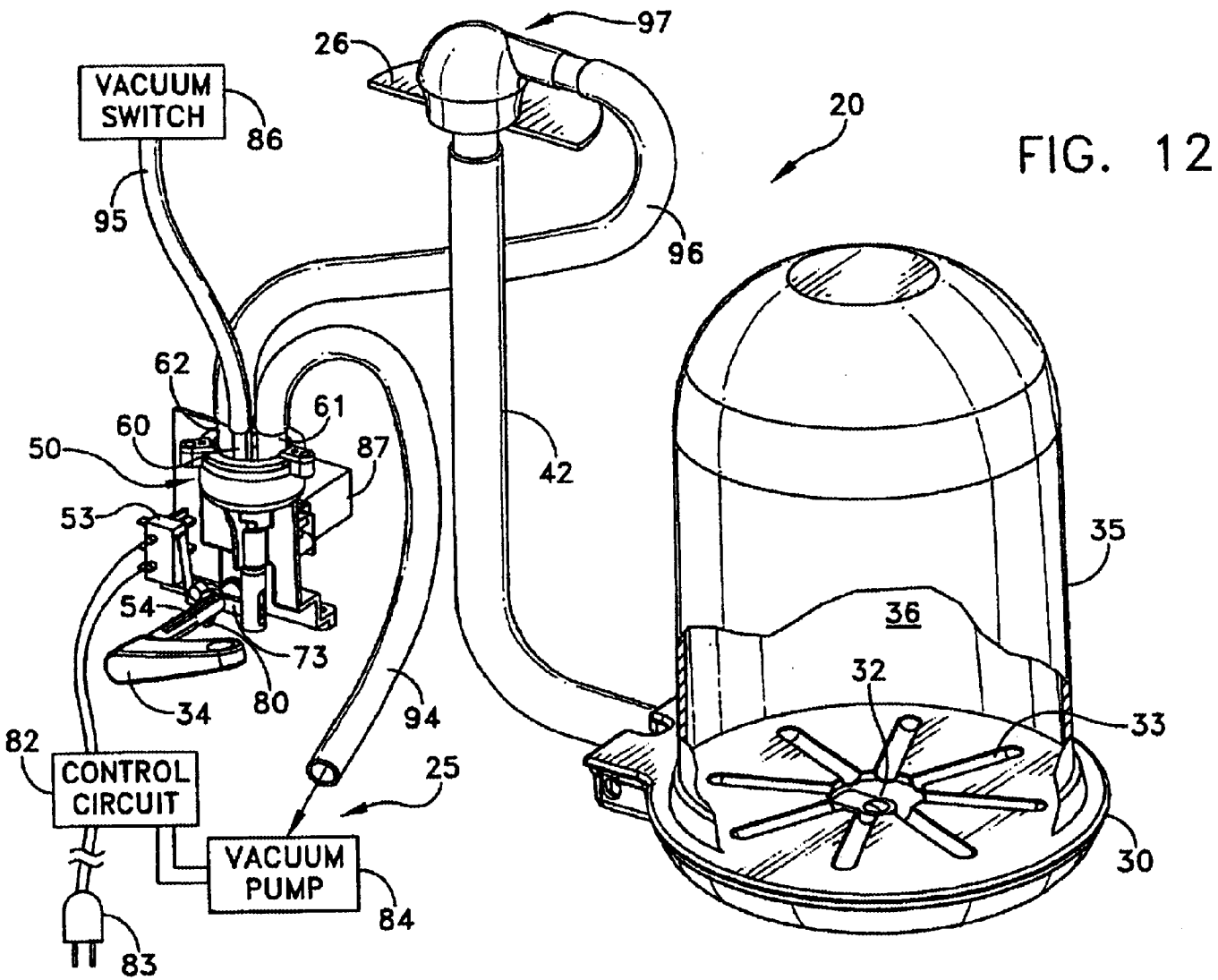
FIG. 12 is a diagram that depicts the interconnection of the various components of the appliance in FIG. 1.

FIG. 12 depicts an arrangement of vacuum hoses or conduits and fittings that enable the previously described evacuation of a container in the vacuum chamber 36. However, the specifically disclosed arrangement also provides another advantage and important operating mode for the appliance 20. This arrangement enables the evacuation of large bowls and the like that can not fit in the vacuum chamber 36. More specifically, FIG. 12 depicts the valve 50 with the ports 60, 61 and 62. A first vacuum hose 94 extends between the vacuum pump 84 and the port 61. A second vacuum hose 95 extends between the port 60 and the vacuum switch 86. A third vacuum hose 96 extends from the port 62 to a releasable interconnection 97 formed in the floor 26. The vacuum hose 42 connects the releasable interconnection 97 and the vacuum chamber base 30. As previously indicated, when the operating lever 34 rotates clockwise, the actuator 73 moves the slider 70 downward so the sealing element 71 and O-ring 72 move to the sealing position shown in FIGS. 9 and 10 and the cam 80 closes the switch 53 and energizes the vacuum pump 84. The vacuum pump 84 then begins to exhaust air from the vacuum chamber 36 and the container 37 through the port 32 and channels 33, vacuum hose 42, the releasable interconnection 97, the vacuum hose 96, the chamber 63 in the valve 50 and the vacuum hose 94.

When the vacuum switch 86 senses an appropriate vacuum level, the switching contacts close and energize the solenoid 87 releasing the detent action on the slider 70, so the sealing element 71 and O-ring 72 move from the sealed position shown in FIGS. 9 and 10 to the unsealed position shown in FIGS. 7 and 8. In addition as the slider 70 moves up, the actuator 73 rotates the shaft 54 and cam 80 to open the switch 53 and de-energize the vacuum pump 84. Air at atmospheric pressure then moves rapidly through the atmospheric port 67, the vacuum hose 96, the interconnection 97 and the vacuum hose 42 into the vacuum chamber 36.

This rapid influx of air produces a rapid pressure increase or shock wave to seal the lid 38 on the container 37. Although this shock wave also reaches the vacuum pump 84 through the hose 94, there are no deleterious effects because vacuum pumps are designed to withstand such rapid pressure increase. Thus, the structure responds to the vacuum switch 86 by releasing the valve to its unsealed position whereby air enters the vacuum chamber 36 to seal the lid 38 to the top of the container 37 and by resetting the position of the operating lever 34 and deactivating the vacuum pump 84.

Figure 13:
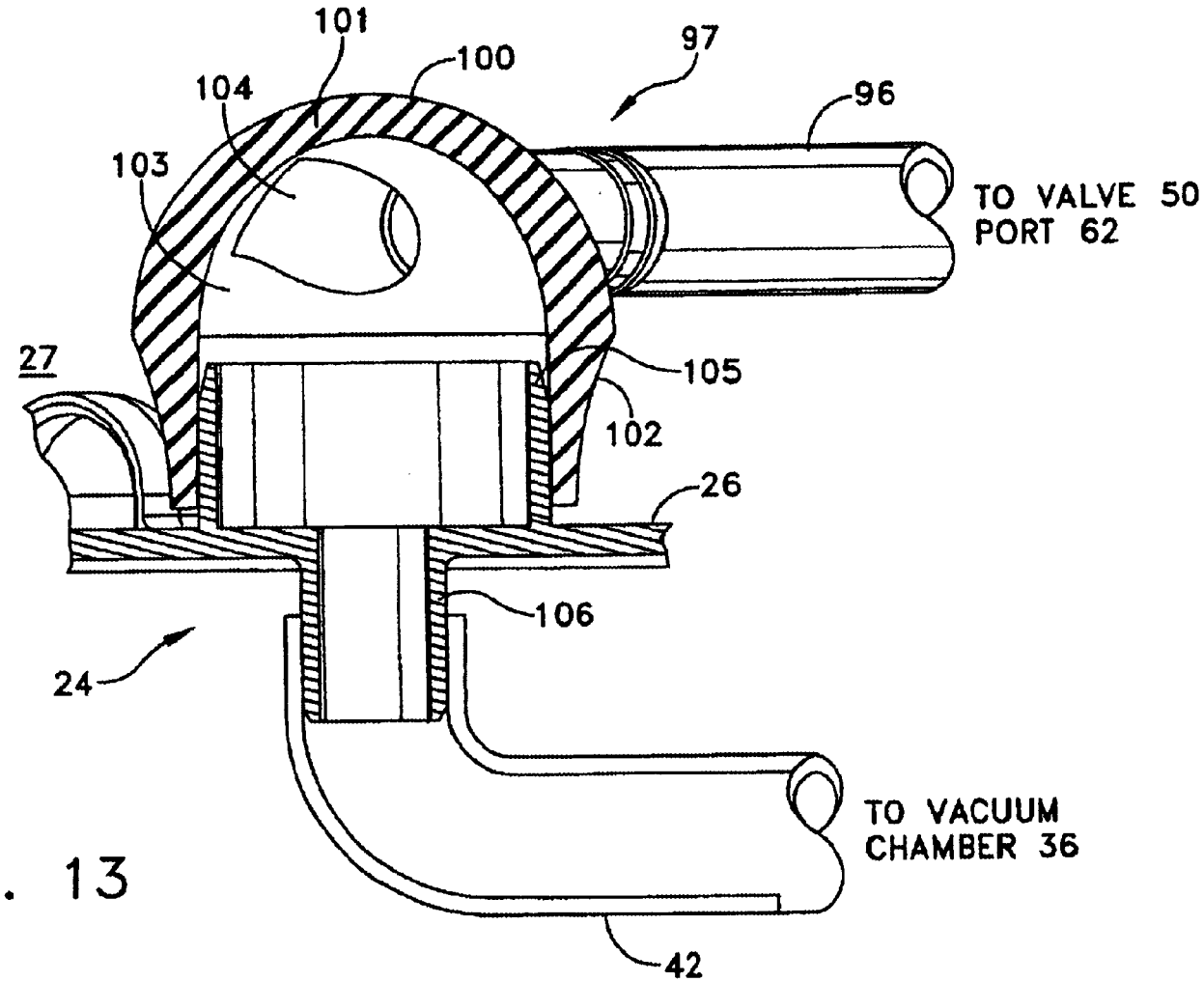
FIG. 13 depicts a releasable interconnection for a vacuum hose that is useful in accordance with this invention.

FIG. 13 depicts the releasable interconnection 97 in greater detail with portions of the vacuum hose 42 from the vacuum chamber base 30 and the vacuum hose 96 from the port 62. The releasable interconnection 97 includes a cup shaped flexible member 100 attached to the end of the vacuum hose 96 and a fitting through the floor 26. More specifically, the flexible member 100 has a spherically shaped portion 101 and an open cylindrical neck or collar 102 that define a cavity 103 and a communicating port 104 to the vacuum hose 96. The floor 26 includes an upwardly extending pipe section 105 and an oppositely extending pipe section 106. The pipe section 106 receives the end of the hose 42, generally in a permanent connection. However, the pipe section 104 receives the flexible member 100 in a releasable fashion. That is, when the flexible member 100 is on the pipe section 105, friction between the two elements holds the neck 102 on the pipe section 105. When a vacuum is drawn, the neck 102 compresses against pipe section 105 to seal the interconnection. When no vacuum conditions exist, the flexible member 100 can easily be withdrawn from and returned to the pipe section 105.

Figure 14:
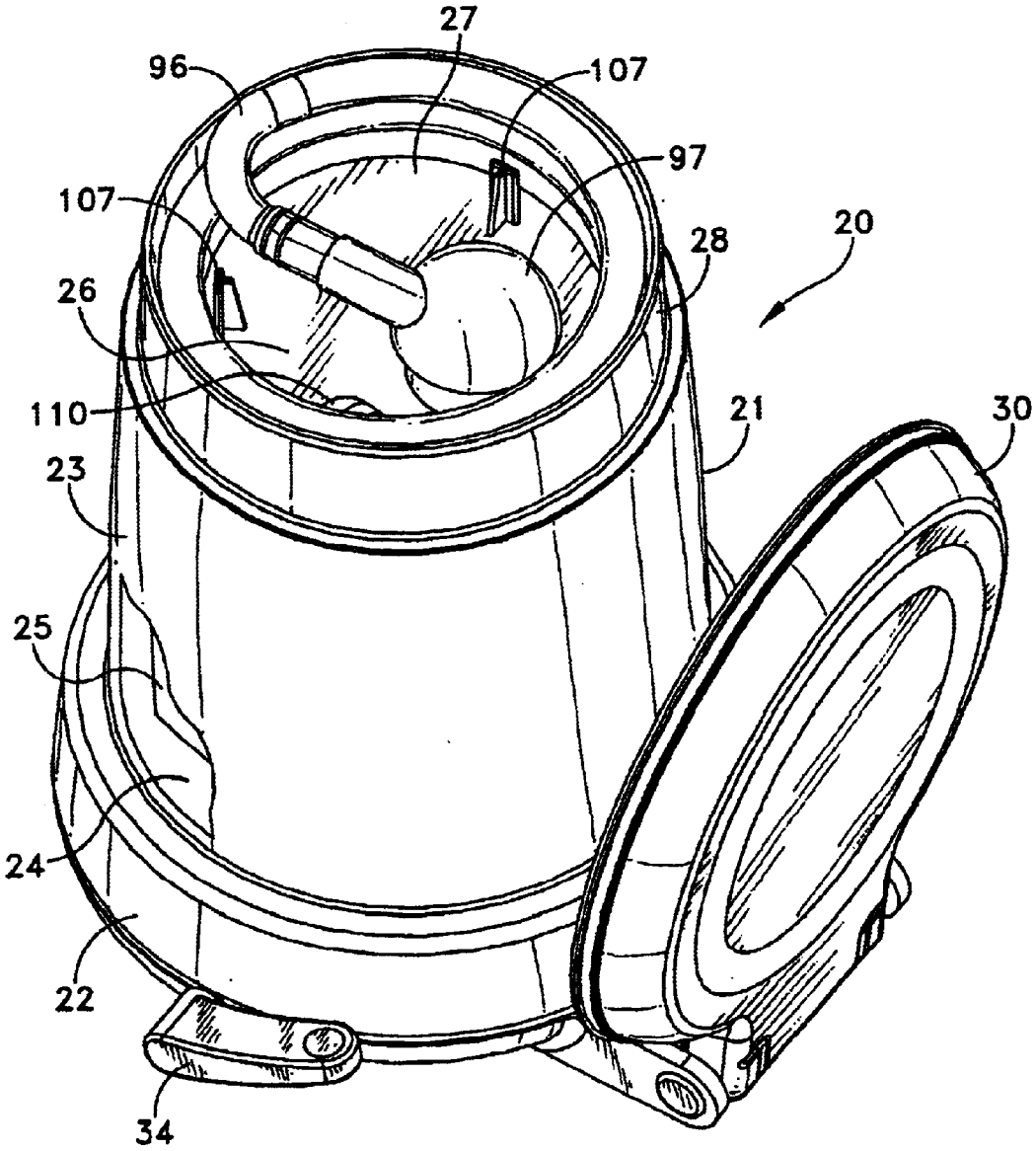
FIG. 14 is a perspective view of the appliance in FIG. 1 adapted for providing remote sealing.

FIG. 14 depicts the appliance 20 after the bell cover 35 and the cover 29 are both removed to expose the upper cavity 27. This view shows the releasable interconnection 97 with the vacuum hose 96 wrapped in a multi-turn coil between the housing 28 and angularly spaced upstanding guides 107. The other end of the vacuum hose 96 connects to a fitting 110 that may be an extension of the port 62.

Figure 15:
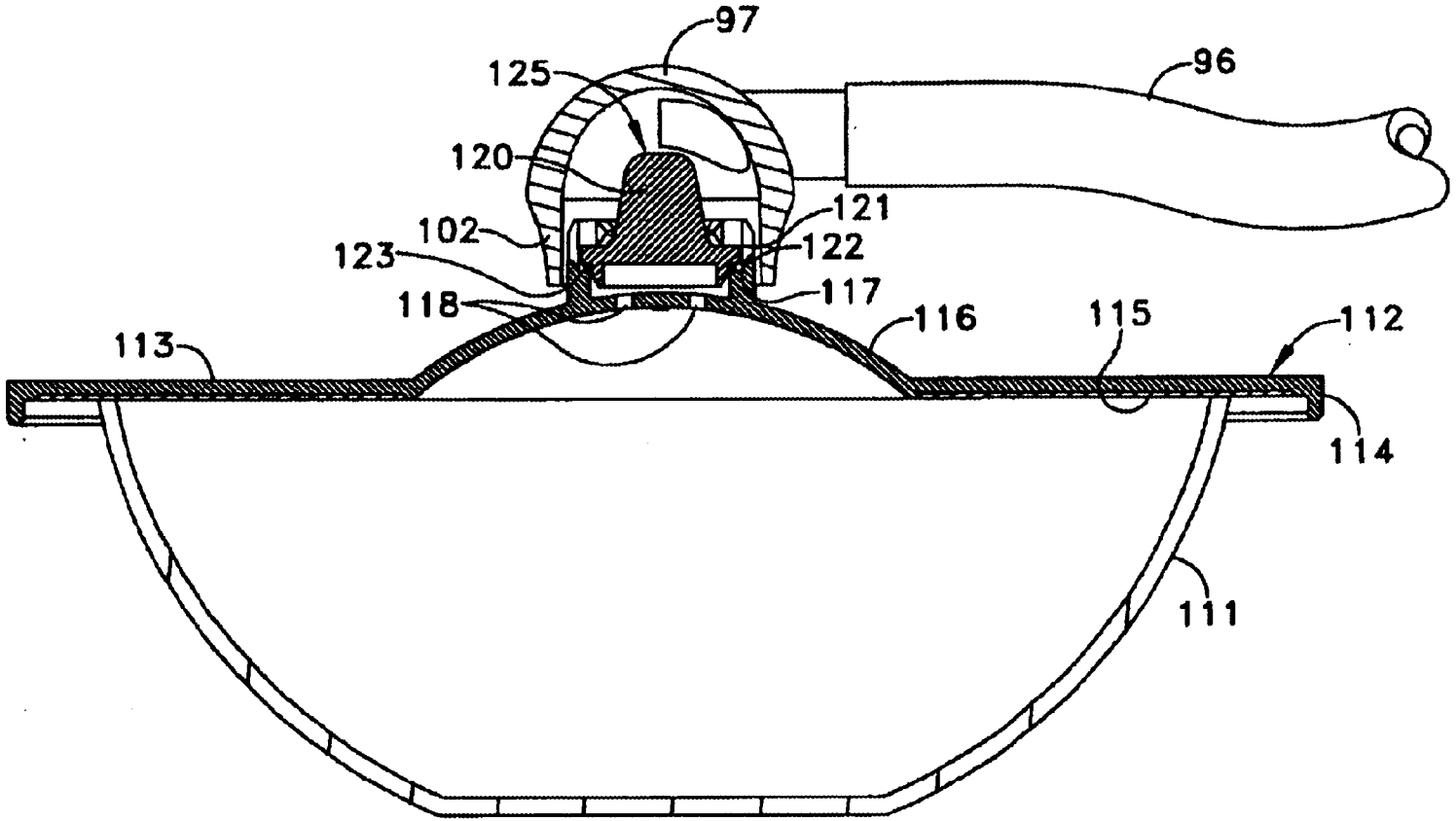
FIG. 15 is a cross sectional view depicting the use of the appliance in FIG. 14 with a lid for remotely sealing a large container.

FIG. 15 depicts a bowl 111 that cannot fit in the vacuum chamber 36. As will also be apparent, lids are often not available as accessories for such bowls. In accordance with this invention, it is possible to provide a reusable lid 112 for such bowls. As a specific example, the lid 112 includes a disk-like body 113 with a circumferential lip 114. A sealing material or structure 114 covers the bottom surface of the disk 113. The center of the lid 112 comprises a dome-like structure 116 with a cylindrical pipe-like extension 117 and a plurality of air passages 118 located through the structure 116 within the confines of the pipe-like structure 117. The dome-like structure 116 strengthens the lid 112 so it is more resistant to deformation when the bowl 111 is evacuated. The pipe-like structure 117 has the same outer diameter as the pipe section 105 in FIG. 13.

The pipe-like section 117 also carries an internal vacuum release structure 120 with a shoulder 121 and O-ring 122. The release structure 120 sits on an internal shoulder 123 formed at the open end of the pipe-like structure 117. An finger pad 125 allows an individual to move or tilt the pressure release structure 120 thereby to break the seal between the O-ring 122 and the shoulder 123.

In use, the bowl 111 is evacuated by positioning the lid 112 as shown in FIG. 15. Then the releasable interconnection 97 is removed from the cylindrical fitting 105 in FIG. 13 and attached to the lid 112 by sliding the neck 102 over the pipe-like extension 117. The operating lever 34 (FIG. 12) is then rotated to initiate the evacuation operation. When the requisite vacuum has been attained, the valve 50 reacts and admits air at atmospheric pressure back through the vacuum hoses 96 and 42 and seals the pressure release structure 120 against the shoulder 123 using the same process as previously described in connection with containers that are sealed in the vacuum chamber 36. Now the releasable connection 97 can be removed to be used with another lid or to be returned to the pipe section 105 thereby to re-enable the use of the vacuum chamber base 30.

As will now be apparent, the disclosed vacuum sealing appliance 20 meets each objective of this invention. The vacuum sealing appliance 20 is improved over other devices particularly for evacuating lidded containers such as the containers 37 and lid 38 in FIGS. 1 and 3. As is particularly shown in FIG. 4, the appliance 20 can be configured to minimize storage requirements. Operation is simple. It is merely necessary to place a container in the vacuum chamber 36 or to place a lid, such as a lid 112, on a bowl, assure that the releasable interconnection 97 is attached appropriately and then to actuate the operating lever 34. Thereafter, all the operation is automatic. Moreover, using the vacuum switch assures that the release point does not vary over time or even from appliance to appliance. The valve 50 and other elements are all readily manufacturable and reliable thereby facilitating manufacture and reducing manufacturing costs. Operation readily lends itself to use in a non-commercial or home environment. The minimal storage requirements, simple operation, the low-cost, easy manufacture and reliability are all characteristics of a vacuum sealer that is clearly adapted for use in a non-commercial or home environment. Moreover, this vacuum sealing appliance has the capability of providing different operating modes by allowing lidded containers to be sealed under a bell cover in one mode and by allowing oversized containers to be evacuated using specially formed lids.

This invention has been described in terms of a specific embodiment with a number of construction features. It will be apparent that any number of variations can be applied to this specifically disclosed embodiment. For example, alternate embodiments of the valve could implement all the functions that are useful in accordance with this invention. A specific configuration and routing of vacuum hoses and fittings is shown; other approaches could also be used. The control system is shown in use with a device with a vacuum sealing appliance that has multiple modes of operation. Some or all of the advantages of this invention could be attained by a system that exclusively uses a bell cover and eliminates the releasable interconnection 97. Alternatively, the releasable interconnection and vacuum chamber base might be eliminated if the appliance were to be used exclusively to seal special lids on bowls as shown in FIG. 15. Therefore, it is the intent of the appended claims to cover all such variations and modifications as come within the true spirit and scope of this invention.

What is claimed as new and desired to be secured by Letters Patent of the United States is:

1. A vacuum sealer for sealing the contents of a lidded container that includes a vacuum pump and a vacuum chamber that receives the container with its lid loosely position thereon, said vacuum sealer additionally comprising a controller comprising:

A) a valve operable between sealed and unsealed positions and including:

i) a valve body having a passage therethrough to a port to the atmosphere, ii) a valve cover closing one end of the passage and including a first port for connection to said vacuum pump, a second port for connection to the vacuum chamber and a third port for connection to said vacuum switch, and iii) a slider having a sealing member thereon for moving between a first position in which said sealing member blocks the passage between said valve cover and said atmospheric port whereby said vacuum pump evacuates the vacuum chamber and a second position in which said sealing member moves to open the passage between said valve cover and said atmospheric port whereby air at atmospheric pressure is admitted to the vacuum chamber, B) a vacuum switch, C) first means for initiating operation of said vacuum sealer by moving said valve to its sealed position and by activating the vacuum pump whereby air is evacuated from the container and vacuum chamber, and D) second electrically operated means responsive to said vacuum switch for releasing said valve to return to its unsealed position whereby air enters the vacuum chamber to seal the lid against the container, said valve upon being released resetting said first means thereby to deactivate the vacuum pump.

2. A vacuum sealer as recited in claim 1 wherein said passage through said valve body has a first cavity of a given cross section located adjacent said valve cover and a second cavity of a lesser cross section displaced from said first cavity, said atmospheric port being spaced from said first cavity and wherein said sealing member has a size corresponding to the cross section of the second cavity whereby the location of said sealing member in said second cavity intermediate said atmospheric port and said first cavity constitutes the sealing position and the location of said sealing member in said first cavity constitutes the unsealed position.

3. A vacuum sealer as recited in claim 1 wherein said second means includes:

i) a solenoid attached to said valve body with an armature normally biased to enable motion of said valve slider from its sealed position, and ii) a control circuit responsive to the operation of said first means for energizing said solenoid thereby to block motion of said valve slider and responsive the detection of a predetermined vacuum in the vacuum chamber by said vacuum switch to shift said solenoid armature to is normally biased position thereby to enable motion of said valve slider by the differential pressure across the sealing member.

4. A vacuum sealer as recited in claim 3 wherein valve body supports an electric switch that controls the energization of said vacuum pump and said first means includes a mechanism for closing said electric switch simultaneously with the movement of said valve slider to the sealed position.

5. A vacuum sealer as recited in claim 1 wherein said first means includes:

i) a rotatable shaft, ii) a first arm extending radially from said shaft for enabling the rotation of said shaft from a first shaft position to a second shaft position, iii) a second radial arm extending from said shaft and spaced from said first arm, said second radial arm engaging said valve slider thereby to move said valve slider from its unsealed position to its sealed position when said first arm moves from its first to its second shaft position, and iv) an actuator connected to said shaft for energizing said vacuum pump.

6. A vacuum sealer as recited in claim 5 additionally comprising an electric switch proximate said valve body and said shaft, said actuator comprising a cam on said shaft to close said electric switch when said shaft is in its second position, said cam being displaced when said valve slider returns to the unsealed position whereby said electric switch deenergizes said vacuum pump.

7. A vacuum sealer comprising:

A) a valve operable between sealed and unsealed positions,

B) a vacuum switch,

C) first means for initiating operation of said vacuum sealer by moving said valve to its sealed position and by activating the vacuum pump whereby air is evacuated from the container and vacuum chamber, D) second electrically operated means responsive to said vacuum switch for releasing said valve to return to its unsealed position whereby air enters the vacuum chamber to seal the lid against the container, said valve upon being released resetting said first means thereby to deactivate the vacuum pump, E) a housing having first and second cavities therein and a wall therebetween and first and second ports extending through said wall, said housing positioning said vacuum pump and a controller in said first cavity, F) a first vacuum hose extending between said first port and said vacuum pump, G) a second vacuum hose extending between said second port and said vacuum chamber base, H) a third vacuum hose in said second cavity connected to said first port and releasably connected to said second port, said third vacuum hose and said second port having complementary fittings, and I) a lid for placement on an open container having a vacuum fitting corresponding to said second port fitting whereby said third vacuum hose can be detached from said second port and attached to said vacuum fitting.

8. A vacuum sealer as recited in claim 7 wherein said third vacuum hose is flexible.

9. A vacuum sealer as recited in claim 7 wherein said second port and adapter fittings have a cylindrical shape and said third vacuum hose fitting forms a cylindrical cavity portion that is coextensive with portions of the attached second port and adapter fittings.

10. A vacuum sealer as recited in claim 9 wherein said adapter has a planar annular portion and a central convex portion that carries said adapter fitting.

11. A vacuum sealer as recited in claim 10 wherein said lid additionally includes a relief valve in said vacuum fitting thereby to enable the release of said lid from the open container to access to the contents.

* * * * *